US005752490A

United States Patent [19]

Rodgers et al.

[11] Patent Number: 5,752,490

[45] Date of Patent: May 19, 1998

[54] RETURNLESS FUEL INJECTION SYSTEM

[75] Inventors: Jack G. Rodgers, Roseville; John J. Schmitz, St Clair Shores, both of Mich.

[73] Assignee: The United States of America as represented by the Secretary of the Army, Washington, D.C.

[21] Appl. No.: 769,643

[22] Filed: Dec. 16, 1996

[51] Int. Cl.[6] ..... F02M 37/04; F02B 77/00

[52] U.S. Cl. ..... 123/497; 123/198 D

[58] Field of Search ..... 123/497, 510, 123/511, 514, 179.16, 179.17, 198 D, 479

[56] References Cited

U.S. PATENT DOCUMENTS

| | | | |
|---|---|---|---|
| 4,217,862 | 8/1980 | Fort et al. | 123/497 |
| 4,284,053 | 8/1981 | Merrick | 123/497 |
| 4,430,980 | 2/1984 | Pidgeon | 123/497 |
| 4,577,604 | 3/1986 | Hara et al. | 123/497 |
| 4,926,829 | 5/1990 | Tuckey | 123/497 |
| 5,056,022 | 10/1991 | Witkowski et al. | 364/424.1 |
| 5,284,119 | 2/1994 | Smitley | 123/497 |
| 5,379,741 | 1/1995 | Matysiewicz et al. | 123/497 |
| 5,406,922 | 4/1995 | Tuckey | 123/497 |
| 5,605,135 | 2/1997 | Netherwood | 123/479 |

*Primary Examiner*—Thomas N. Moulis

*Attorney, Agent, or Firm*—Peter A. Taucher; Gail S. Soderling

[57] ABSTRACT

An improved fuel injection system for use with an internal combustion engine mounted in a vehicle. The fuel system has fuel, a fuel pump, a throttle position sensor for sensing the power requested, and an engine control unit. The improvement comprises a fuel pump control circuit using three distinct duty cycle modulator circuits to control fuel pump speed. One duty circuit is used on startup to bring the system to full operating pressure, a second duty circuit provides modulated pulses to the fuel pump to operate the fuel pump at the level set by the throttle position sensor and a third duty circuit operates the fuel pump at idle the third duty circuit maintaining the fuel flow at a level which prevents vapor lock and being also adapted to operate the fuel pump at the reduced level in the event of throttle position sensor failure.

1 Claim, 1 Drawing Sheet

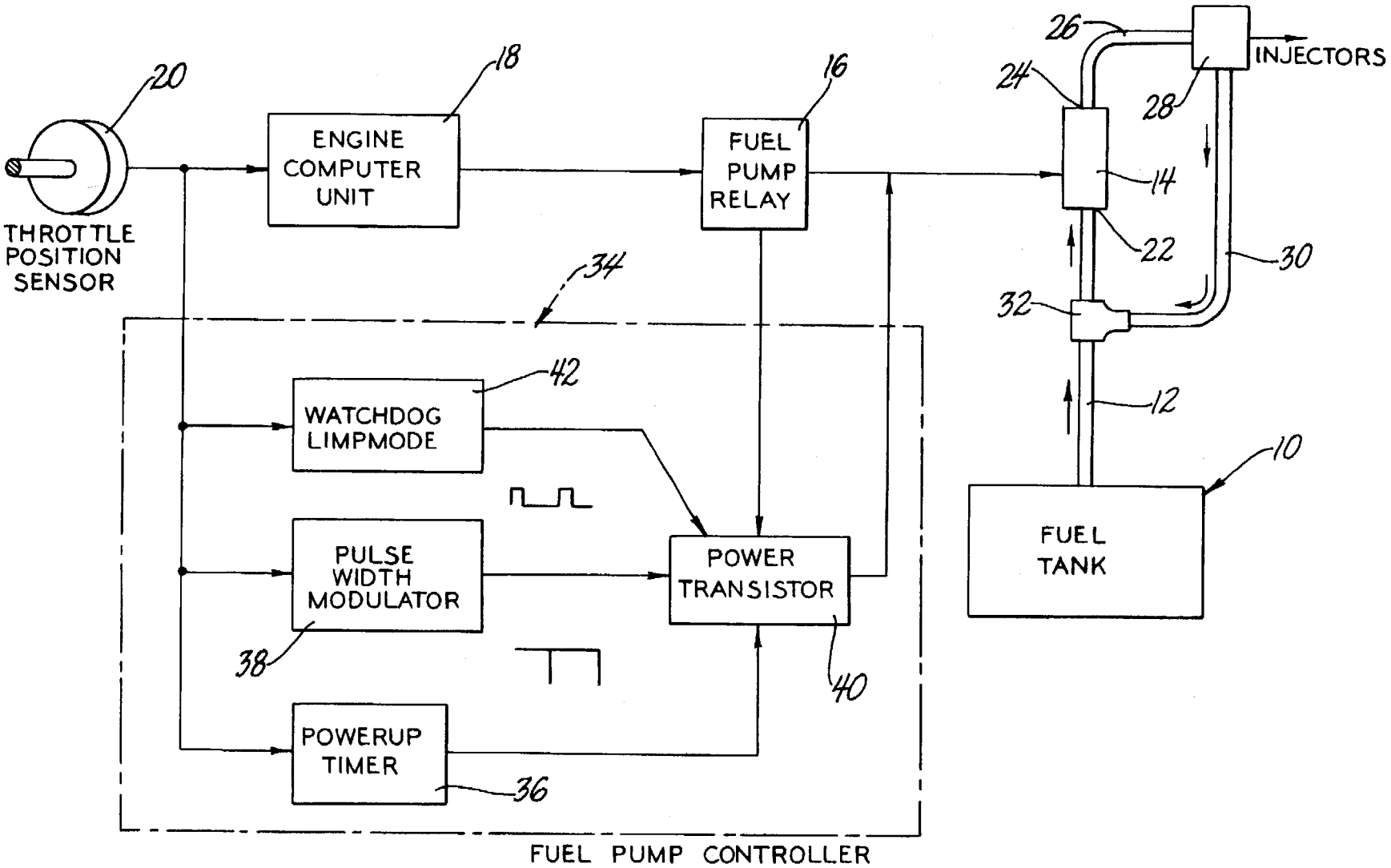
INJECTORS
30
10
28
14
22
12
26
24
32
FUEL TANK
16
FUEL PUMP RELAY
POWER TRANSISTOR
40
34
42
36
18
ENGINE COMPUTER UNIT
WATCHDOG LIMPMODE
PULSE WIDTH MODULATOR
POWERUP TIMER
38
FUEL PUMP CONTROLLER
20
THROTTLE POSITION SENSOR

RETURNLESS FUEL INJECTION SYSTEM

GOVERNMENT INTEREST

The invention described here may be made, used and licensed by or for the U.S. Government for governmental purposes without paying me any royalty.

BACKGROUND OF THE INVENTION

1. Field of the Invention

In one aspect this invention relates to fuel injection systems used in cars and marine engines. In a further aspect this invention relates to the structure for returning unused fuel to the storage area. In yet a further aspect, this invention relates to an engine control system for allowing an engine to operate safely at a reduced speed.

2. Prior Art

In general, there has been an increase in the number of fuel injected engines and most new cars, small trucks, and marine engines now rely on fuel injection systems instead of carburetors as the means of providing fuel to the engines. This has created engines with greater fuel efficiency and higher reliability. The present systems have a fuel pump which runs at a constant rate to provide pressurized fuel to the injector system containing one or more fuel injector nozzles. This provides a constant flow of fuel at operating pressure sufficient to run the engine at maximum power. However such a flow is far greater than that needed to power the engine at lower power output creating an excess fuel flow at low operating power and the situation is even worse at engine idle. Thus a return mechanism is incorporated in the injector system to remove excess fuel from the line and return it to the storage tank.

The requirement for a return line results in certain problems. The return line structures require a complex system of fuel lines and valves which is expensive to produce, difficult to maintain safely and hard to repair, particularly in marine engines. Some systems try to alleviate some of the problems by creating a bypass which recycles the unused fuel back to the to the pump rather than the tank. Using a bypass structure causes a heat buildup in the fuel contained in the recycling portion of the fuel system. Over heated fuel can create vapor lock which will temporarily disable the engine as well as degrading engine performance because engines are not tuned to run on preheated fuel.

As a specific example, the marine engines used in many boats are based on 300 to 400 cubic inch displacement blocks. Such engines consume up to 45 gallons of fuel per hour at maximum operating power; thus, requiring a fuel pump capable of sustained 45 gal per hour operation at the required operating pressure. When idling such engines typically consume about 1.5 gallons per hour. If the fuel pump operation is maintained at the 45 gallon per hour rate only a small portion of the fuel will be consumed and the remaining fuel must be recycled. If there is no return to the fuel tank the recycling will be through the pump and only about 3% of the fuel flow will be consumed. The fuel pump generates considerable heat as it operates and transfers a substantial portion of the heat into the fuel as it is being circulated under pressure. Under constant recycling and low consumption operation the cycling will raise the fuel temperature to an unacceptable level in a short period of engine idling condition causing stalling and or vapor lock. In an extreme condition there exists the possibility of a fire. It has been estimated that a system which has about a 10% replenishment rate of new fuel from the tank added to the recycled fuel will provide a better performing system with the replenishment fuel providing adequate cooling to minimize the problems encountered in recirculating systems. Since a minimum of 10% replenishment fuel is desired, a system which has an operating fuel flow of about 15 gallons per hour maximum under idle conditions would meet the minimum standard for adequate cooling. Further, a system at about 10 gallons per hour would provide a better cooling structure with an extra measure of safety.

The present invention provides a fuel pump control means associated with a fuel pump which controls the fuel pump speed to a level where the additional fuel added to the recirculating fuel is sufficient to provide the required cooling to the fuel pump to maintain the recycled fuel at a proper operating temperature.

SUMMARY OF THE INVENTION

Briefly the present invention provides an improved fuel injection system for use with an internal combustion engine. The improved fuel system has a fuel tank for storing a quantity of liquid fuel to be burned by the internal combustion engine to provide power. A fuel pump is provided for drawing fuel from the tank and delivering fuel to a fuel injector system consisting of one or more fuel injectors. The fuel control system has a throttle position sensor which will activate a circuit which in turn will control the fuel pump speed at the rate which allows the addition of sufficient fuel to maintain the fuel temperature below the level which will induce vapor lock.

BRIEF DESCRIPTION OF THE DRAWING

In the accompanying drawing the FIGURE represents a functional diagram of one embodiment of this invention.

DETAILED DESCRIPTION

Referring to the accompanying drawing, a returnless fuel injection system is set out schematically. The system has a fuel tank 10 adapted to hold a quantity of liquid fuel such as diesel fuel or gasoline useable by an internal combustion engine used to power the vehicle, boat or other device. The fuel tank 10 has an outlet line 12 having one end connected to the a fuel pump 14.

In general, the fuel pumps contemplated in the practice of this invention are the high pressure fuel pumps used in modern fuel injection systems such as gerotor type pumps which can deliver the necessary operating pressures i.e. 20 to 40 psi and flow rates up to 45 gallons per hour required for high performance engines. The operating pressure will depend on the type of system being employed throttle body injectors generally using pressures at the lower end of the range and multiport injection systems using the higher pressures. The fuel pump 14 is commonly controlled by a fuel pump relay 16 which is in turn adjusted by an engine control computer unit 18 common on today's engines. The engine control computer unit 18 is in turn responsive to a throttle position sensor 20 which establishes the amount of power requested by a vehicle operator. The engine control computer 18 receives feed back from a number of sensors located on the vehicle, not shown, and integrates them to match the output performance to the operator requested performance set by the throttle position sensor 20.

Fuel from the fuel tank 10 is drawn to the fuel pump 14 at inlet 22 and passes through the fuel pump 14 to an out let line 26 and into a regulator 28 which allows fuel to flow into a fuel injector, not shown. When signaled by the engine control computer unit 18 the injector will open for a short period of time and a measured quantity of fuel will be dispensed for combustion. Fuel not used will exit the regulator 28 through a bypass line 30 and be returned to a bypass valve 32 connection located in fuel line 12 between the fuel tank 10 and the fuel pump 14. The bypass valve 32 is preferably located near the fuel pump 14 to minimize the recycle distance. The low pressure generated by the fuel pump 14 at inlet 22 will create a lowered pressure at the bypass valve 32 drawing replenishment fuel from the tank 10 to replace the fuel consumed by the engine as the fuel passed the injectors.

The throttle position sensor 20 will generate a continuously variable voltage which is an analog signal generally ranging from about 0.5 volt to 4.5 volts between the lowest, idle position, and the full open position. The throttle position voltage generated signals the engine speed desired by the operator. The present invention has a fuel pump control circuit 34 which senses the throttle position sensor voltage and adjusts the speed of fuel pump 14 accordingly.

The fuel pump control circuit, designated generally 34 of this invention is disposed between the fuel pump 14 and the fuel pump relay 16. The fuel pump control circuit 34 is connected to the throttle position sensor 20 and receives the analog output voltage signal from the throttle control position sensor. A power transistor 40 receives power from the fuel pump relay 16 and will furnish the power to the fuel pump 14 in response to the duty cycle imposed on the power transistor by one of three individual duty circuits in the fuel pump control circuit 34 as discussed below. When the engine is started, the first duty circuit, a power up timer 36 is activated in the fuel pump control circuit 34 and the power transistor 40 will provide full time power to the fuel pump 16 which causes the fuel pump to operate at full speed for a predetermined time such as a minute or slightly more to fully pressurize the system to its operating pressure and ensure adequate power as the engine begins operation. After the power up timer 36 has completed the start up function it will shut off and the second duty circuit, a pulse width modulator circuit 38 assumes control of the power transistor 40 and fuel pump 14. The pulse width modulator 38 will provide modulated, pulsed step power to the fuel pump using various width pulses to the fuel pump to control the pumping action. A greater pulse width is used to provide greater fuel pump output and vice versa. With the throttle position sensor 20 at full throttle setting its voltage out put will be at the maximum and the pulse width modulator will deliver an essentially 100% steady power level to the power transistor 40 resulting in the pump 14 operating at full pumping capacity. The pulse width modulator 38 should be calibrated so that the fuel pump 14 always provides more fuel capacity than the engine needs to maintain a positive pressure in the fuel line 12. Lack of adequate pressure will inhibit engine performance since fuel injectors are designed to operate properly with a relatively constant high pressure fuel supply and an excess of fuel available at the injector.

The pulse width modulator 38 is calibrated so that as the throttle position sensor approaches the idle mode and the voltage approaches its idle voltage, the pulse width modulator shuts off and the third duty circuit, a low power cycle pulse modulator 42 assumes the control function. The low power cycle pulse modulator 42 delivers a consistent pulse width of about 15% to 20% duration to the power transistor 40. At the 15% modulated level, the fuel pump 14 will be pumping only a modest amount of fuel which will serve to keep the engine above a stall speed and the fuel pump 14 above its stall speed so performance can ramp up in a timely fashion when the throttle position sensor 20 is changed to accelerate. At idle mode the fuel pumped will be sufficient to maintain the fuel pressure and at the same time enough new fuel from the tank is required that the fuel recycling will remain cool enough to prevent vapor lock and other problems associated with fuel overheating in the fuel recycling lines. The low power width pulse monitoring circuit 42 can be set so it delivers the required low performance pumping even when and independent of the throttle position sensor input so that even if the throttle position sensor fails, the system will provide a minimal amount of fuel pumping power allowing limp home capability even when the throttle position sensor breaks.

Various alterations and modifications will become apparent to those skilled in the art without departing from the scope and spirit of this invention and it is understood this invention is limited only by the following claims.

What is claimed is:

1. An improved fuel injection system for use with an internal combustion engine mounted in a vehicle the fuel system having a fuel tank for storing a quantity of liquid fuel to be used by the internal combustion engine, a fuel pump for drawing the liquid fuel from the tank and delivering the fuel to a fuel injector, a throttle position sensor for sensing the power requested by the vehicle, an engine control unit which controls the engine settings to maintain the engine in its normal operating mode, the improvement comprising a fuel pump control circuit adapted to sense the throttle position output signal, the fuel pump control sensor adapted to respond to the throttle sensor to adjust the fuel pump speed circuit using three distinct duty cycle modulator circuits to control fuel pump speed, one duty circuit being used on startup to bring the system to full operating pressure, a second duty circuit to provide modulated pulses to the fuel pump to operate the fuel pump at the level set by the throttle position sensor and a third duty circuit which operates the fuel pump at idle, the third duty circuit maintaining the fuel flow at a level which prevents vapor lock and being also adapted to operate the fuel pump at the reduced level in the event of throttle position sensor failure at a rate above the stall rate of the fuel pump.

* * * * *